United States Patent [19]

Shiba et al.

[11] Patent Number: 4,760,857

[45] Date of Patent: Aug. 2, 1988

[54] WASHING DEVICE FOR A ROLLER PART IN A MACHINE UNIT AND THE LIKE

[75] Inventors: Noriyuki Shiba, Tokyo; Tomoshi Kawata, Kanagawa, both of Japan

[73] Assignee: Kabushikigaisha Tokyo Kikai Seisakusho, Tokyo, Japan

[21] Appl. No.: 906,276

[22] Filed: Sep. 10, 1986

[30] Foreign Application Priority Data

Sep. 12, 1985 [JP] Japan ..... 60-139716[U]

[51] Int. Cl.[4] ..... B08B 3/02; B41F 35/04

[52] U.S. Cl. ..... 134/144; 101/425

[58] Field of Search ..... 134/104, 144, 153, 155; 101/366, 423, 425; 118/104, 203

[56] References Cited

U.S. PATENT DOCUMENTS

| | | | |
|---|---|---|---|
| 1,185,668 | 6/1916 | Hoe | 101/425 |
| 3,924,531 | 12/1975 | Klingler | 100/366 X |
| 3,926,114 | 12/1975 | Matuschke | 101/366 X |
| 3,976,007 | 8/1976 | Junghans et al. | 101/425 |
| 3,990,365 | 11/1976 | Paulson | 101/425 X |

FOREIGN PATENT DOCUMENTS

| | | | |
|---|---|---|---|
| 2339906 | 2/1975 | Fed. Rep. of Germany | 101/425 |
| 3016910 | 11/1981 | Fed. Rep. of Germany | 101/425 |
| 92565 | 6/1983 | Japan | 101/425 |
| 92566 | 6/1983 | Japan | 101/425 |
| 1169668 | 11/1969 | United Kingdom | 101/425 |

*Primary Examiner*—Philip R. Coe

*Attorney, Agent, or Firm*—Foley & Lardner, Schwartz, Jeffery, Schwaab, Mack, Blumenthal & Evans

[57] ABSTRACT

A washing device is capable of carrying out washing work in a roller part of a machine unit automatically, continuously, concentrically and uniformly. The washing device employs a washing solvent storage tank, and a used washing solvent storage tank,. The device transfers washing solvent in a washing solvent storage tank to a machine unit with a roller to be washed, supplies washing solvent to the roller to be washed set at the end point of the transfer means, a used washing solvent collecting means collects used washing solvent from the proper position of a roller to be washed, and discharges collected used washing solvent to a used washing solvent storage tank.

8 Claims, 2 Drawing Sheets

WASHING DEVICE FOR A ROLLER PART IN A MACHINE UNIT AND THE LIKE

BACKGROUND OF THE INVENTION

1. Field of the Invention

The present invention generally relates to a washing device for a roller part in a machine unit equipped with a roller surrounded with a flexible portion and with an ink cylinder (a metal cylinder). More particulary, the present invention relates to a washing device for a roller part requiring frequent washing in a machine plant, where a plurality of machine units, such as a rotary printing machine, are arranged in a line and a coating machine.

2. Description of the Prior Art

In a machine unit equipped with a roller part, such as a rotary printing machine and a coating machine, a flexible surface portion of a roller and a cylinder is required to be washed frequently and in case of necessity, for example, after the printing work, by the exchange of ink or coating solvent and by a inspection and a maintenance and the like.

In the prior art, after the printing work in the printing factory, a conventional washing device for a roller surrounded with the flexible portion has been employed. The conventional washing device is disclosed in the Page 108 of Japanese publication entitiled "Offset Printing Machine" published on June 25, 1984 by Japan Printing Press Publishing Co. and in the Page 285 of Japanese publication entitled "Press Printing Section Printing Revised Edition" published on Oct. 31, 1980 by Japan Press Association. FIG. 3 is an elevational view of the conventional washing device in the prior art as one example of a washing device for a roller surrounded with the flexible portion. The blade (21) in this washing device contacts the surrounding surface of the proper metal cylinder, while making the roller and cylinder in the machine unit revolve. Consequently ink and coating solvent on the surface of the flexible portion surrounding the roller (22) and cylinder is washed off by this blade (21) while at work. This washing device for a roller surrounded with the flexible portion is removed from the machine unit after the washing work is finished, is cleaned by wiping away by human hands, then is prepared for the next washing work and put back into the same machine unit.

In the prior art washing device, some of the following problems may be found. Washing solvent is supplied into the washing device by human hands so that the washing solvent is supplied often unevenly to the width direction of the flexible portion, namely to the axis direction of the roller and cylinder. This may cause a problem in that washing solvent may be used uselessly in quantity. Since the washing means must be removed from the machine unit and must be cleaned by human hands, this washing work is very complicated and soils the worker, causing a worker mental stress. Further, washing work under the prior art washing device depends heavily on human hands so that it may also cause other difficulty, such as that centralized control for this work is impossible to the worker.

SUMMARY OF THE INVENTION

It is an object of the present invention to carry out, evenly and correctly the washing for a roller part in a machine unit of a rotary printing machine and coating machine by means of continuous and uniform supplying of washing solvent and to prevent unnecessary overuse of washing solvent caused by uneven supply of washing solvent.

It is another object of the present invention to improve work-efficiency and save human labor by means of carrying out the washing work in the above described roller part automatically and continuously, and further to wash simultaneously not only individual devices but also the whole machine unit and to control centrally those washing work process.

To accomplish the above object, the washing device of the present invention comprises a washing solvent storage tank, a used washing solvent storage tank, a washing solvent transfering means to transfer washing solvent in a washing solvent storage tank to a machine unit with a roller to be washed, a washing solvent supplying means to supply washing solvent to the roller to be washed set at the end part of the transfering means, a used washing solvent collecting means to collect used washing solvent from the proper position of a roller to be washed and a used washing solvent discharging means to discharge collected used washing solvent up to a used washing solvent storage tank.

DETAILED DESCRIPTION OF THE PREFERRED EMBODIMENT

Figure 1:
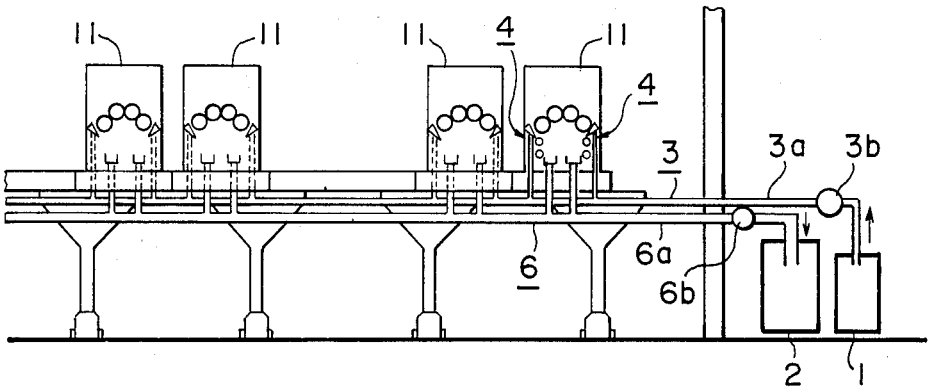
FIG. 1 is a schematic elevational view showing the preferred embodiment of the printing machine unit according to the present invention.
Figure 2:
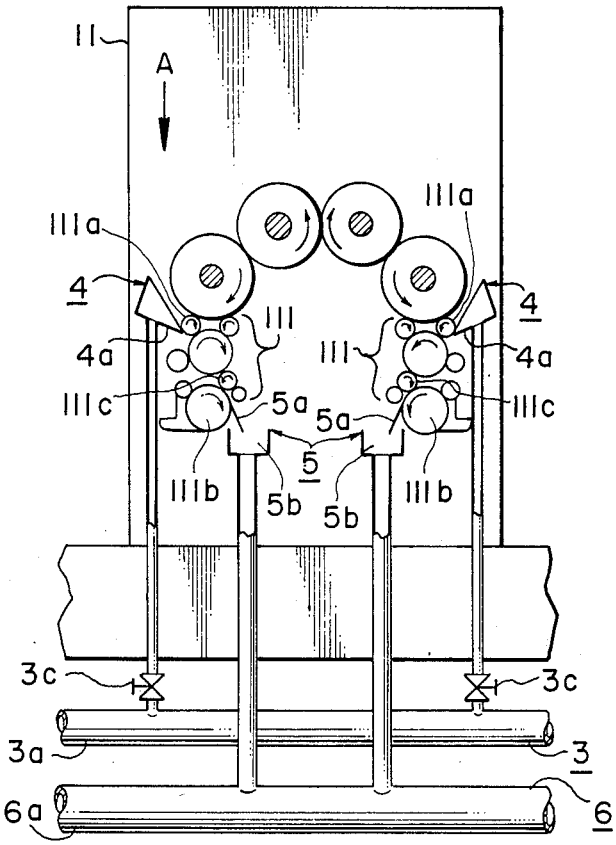
FIG. 2 is an enlarged schematic elevational view showing an essential portion of the printing machine unit and FIG. 3 is a schematic elevational view showing the prior embodiment example
Figure 3:
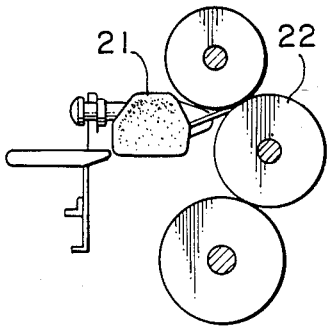
FIG. 3 PRIOR ART

Referring to FIG. 1, there is shown a elevational view of the preferred embodiment of the printing machine unit, to which the present invention is applied, and referring to FIG. 2, there is shown a enlarged view of a part of FIG. 1.

Reference numeral (1) denotes a washing solvent storage tank. The washing solvent storage tank (1) stores washing solvent, which is used to wash a roller part (111) in a printing machine unit (11), such solvents may be light oil, kerosene, washing oil, volatile oil and so on. The reference numeral (2) denotes a used washing solvent storage tank (2). This tank stores used washing solvent, which has been used to wash the roller part (111) in the printing machine unit (11). Both the washing solvent storage tank (1) and the used washing solvent storage tank (2) are set up, not respectively to every printing machine units (11), but instead independently apart from the printing machine units (11).

Reference numeral (3) denotes a washing solvent transfering means. The washing solvent transfering means (3) comprises a main pipe (**3*a*) connecting the washing solvent storage tank (1) with each printing machine unit (11) and a force pump (3*b*), which forces washing solvent with pressure through the main pipe (3*a*) from the washing solvent storage tank (1) up to each printing machine unit (11). At each branch from the main pipe (3*a*) to each printing machine unit (11), proper valves (3*c*) are respectively included to control the transfer of washing solvent to a printing machine unit (11**) for which the washing is not necessary.

The reference numeral (4) denotes a washing solvent supplying means, which is located at the end point of the branch from the main pipe 3*a* to each printing machine unit in the washing solvent transfering means (3). The washing solvent supplying means (4) is equipped with a proper nozzle (4*a*) capable of making a fine adjustment for quantitative supply of washing solvent. Moreover it is desired that the nozzle be disposed at the highest position (the highest roller) (111*a*) or at the neighborhood of the roller part (111) to be washed in the printing machine unit in order to make washing solvent supply possible.

Figure 4:
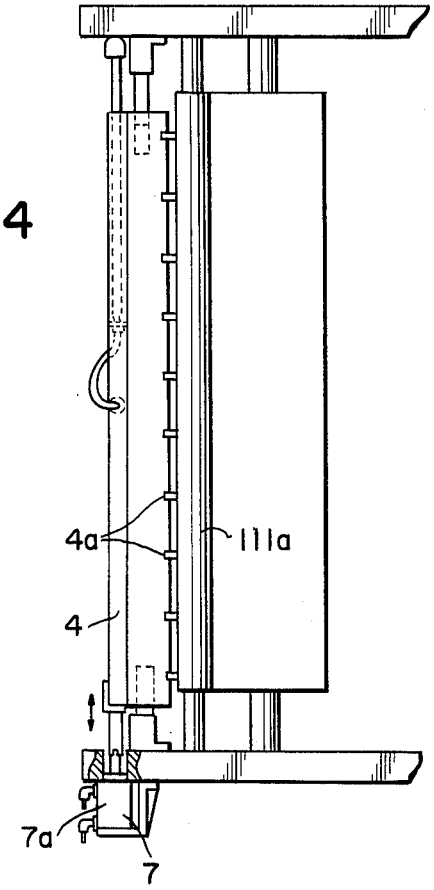
FIG. 4 illustrates reciprocated washing solvent supply means.
Figure 5:
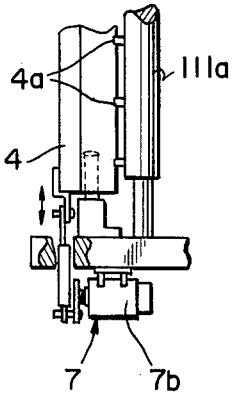
FIG. 5 is another embodiment of the reciprocated means.

In this preferred embodiment, the nozzle (4*a*) is disposed toward the the axis direction (to the inside direction from the elevational side in the drawing) of the roller part (111) so as to make a reciprocating movement. Reference numeral 7 in FIG. 4 denotes the reciprocated means. Fluid cylinder 7*a* provides the washing solvent supplying means 4 a reciprocating movement in the axis direction. The reciprocating movement may be actuated through a proper gear by means of an electric motor, the actuation of which may be linked with that of a supply pump (3*b*). In FIG. 5 the reciprocated means has electric motor 7*b*, which rotates to activate the reciprocated means. The number of moving nozzles may be 1 or a optional number more than 2 as needed. Further, the nozzle (4*a*), disposed securely and besides a plurality of another nozzles (4*a*), may be arranged additionally in parallel to the axis direction of the roller part (111).

Reference numeral (5) denotes a used washing solvent collecting means. The used washing solvent collecting means (5) comprises a blade (5*a*), contacting with pressure the surrounding surface of the ink cylinder (the metal cylinder) (111*b*) in the lowest position of the roller part (111) on a parallel with the axis line of the ink cylinder (111*b*) and which can be detached from the ink cylinder, and further comprising a collecting gutter (5*b*), in which used washing solvent is raked up and collected by the blade (5*a*). The blade (5*a*) is arranged to extend the whole length of the ink cylinder (111*b*), to which the blade is contacted with pressure.

The collecting gutter (5*b*) for raking together used washing solvent is also arranged extending the whole length of ink cylinder (111*b*) under the blade (5*a*) and in parallel with the above described blade.

Reference numeral (6) denotes a used washing solvent discharging means. The used washing solvent discharging means (6) comprises a main discharge pipe (6*a*) which links each printing machine unit (11) to the used washing solvent storage tank (2) and a discharge pump (6*b*), by which used washing solvent is discharged from each printing machine unit (11) to the used washing solvent storage tank (2) through the main discharge pipe (6*a*). The main discharge pipe (6*a*) is branched to every printing machine unit (11) and is linked to the collecting gutter (5*b*).

The blade (5*a*) for raking together used washing solvent is contacted with pressure to the surrounding surface of the ink cylinder (111*b*) in the lowest position and then the printing machine unit is actuated and the roller part (111) to be washed is revolved. Simultaneously, the force pump (3*b*) starts operating to supply washing solvent to the roller (111*a*) in the highest position of the roller part (111).

The ink cylinder (111*b*), to which the blade (5*a*) is contacted with pressure, contacts the surrounding surface of the adjointed rubber roller (111*c*) under the condition that ink on the surrounding surface of the ink cylinder (111*b*) is raked up by the blade (5*a*) so that the ink layer is thined on its surface. As a result of the contact between the ink cylinder (111*b*) and the rubber roller (111*c*), a part of ink layer on the surrounding surface of the rubber roller (111*c*) is transfered to the surrounding surface of the above described ink cylinder reducing the unbalanced condition of the ink layer between them. This means that the transferance of the ink layer is extended to the whole surrounding surface of all rollers and cylinders adjoined with each other and consequently ink on the roller part (111) is collected into the collecting means (5), as the ink layer on the ink cylinder (111*b*) in the lowest position is raked up continuously.

On the other hand, washing solvent supplied from the highest position of the roller part (111) consists of light oil, kerosene, washing oil, volatile oil etc., so that the ink consistency is reduced according to the inflow of washing solvent to ink and the ink's adhesion to the surrounding surface of the roller and the cylinder is weakened. Washing solvent makes it easier for ink to drop by its weight and functions to collect ink speedily and completely by the above described blade. Washing solvent and ink which is collected by the blade (5*a*) is discharged to the used washing solvent storage tank (2) by means of the discharging means through the actuation of the discharge pump (6*b*).

Direct intervention by human hands, is not necessary in the present invention. This not only the saves human hand work and removes the physical and mental burden of a practical labor but also increases the work-efficiency through the automatical and consecutive washing work. Further, washing solvent is supplied uniformly and a washing unevenness does not occur. Thus, a waste of washing solvent, which comes from the unevenness of washing solvent supply, can be prevented through its uniform supply. Moreover, the control for the printing machine is concentrated easily and used washing solvent is collected automatically and consecutively so that it gets comparatively easier for the worker to throw used washing solvent away.

What is claimed is:

1. A washing device for a plurality of roller parts in a machine unit, each said roller part comprising at least one roller, said washing device comprising;

a washing solvent storage tank located remote from said roller parts, a used washing solvent storage tank located closely adjacent to said washing solvent storage tank, a washing solvent transferring means for transferring washing solvent in said washing solvent storage tank up to said machine unit with a plurality of roller parts, said washing solvent transferring means further comprising a main pipe connected to a plurality of branch pipes, each said branch pipe leading to a said roller part and having valve means for regulating washing solvent transfer to said branch, a washing solvent supplying means for supplying washing solvent as needed to a said roller part arranged at an end point of a said branch of said washing solvent transferring means, a used washing solvent collecting means for collecting used washing solvent from a roller part, and a used washing solvent discharging means for discharging collected used washing solvent to said used washing solvent storage tank, said discharging means further comprising a main discharge pipe branched to at least one collecting gutter in each said roller part of said machine unit, and a discharge pump for discharging used washing solvent into said used washing solvent storage tank.

2. A washing device as set forth in claim 1, including a plurality of rollers wherein at least one roller is positioned above other rollers and wherein washing solvent supplying means is located above said roller which is positioned above said other rollers.

3. A washing device as set forth in claim 1 or 2, wherein said washing solvent supplying means comprises nozzle capable of a fine adjustment in the supply of washing solvent.

4. A washing device as set forth in claim 1 or 2, wherein said washing solvent supplying means includes means for reciprocating washing solvent along an axis direction of said roller part.

5. A washing device as set forth in claim 1 or 2, wherein a plurality of said washing solvent supplying means are equipped on a parallel with an axis direction of the roller part.

6. A washing device as set forth in claim 1 or 2, wherein said washing solvent supplying means is equipped with a nozzle means for finely adjusting washing solvent supply capable of reciprocating movement along the length of said roller part.

7. A washing device for a roller part in a machine unit as set forth in claim 1 or 2, wherein said washing solvent supplying means is equipped with a plurality of nozzles parallel to an axis direction of the roller part, said nozzles including means for finely adjusting said washing solvent supply.

8. A washing device for a roller in a machine unit as set forth in claim 1 or 2, wherein said used washing solvent collecting means comprises a blade which can be contacted and be separated without restraint and a collecting gutter set under the blade.

* * * * *